US011047238B2

(12) United States Patent
Guegan et al.

(10) Patent No.: US 11,047,238 B2
(45) Date of Patent: Jun. 29, 2021

(54) LEADING EDGE PROFILE OF VANES

(71) Applicant: SAFRAN AIRCRAFT ENGINES, Paris (FR)

(72) Inventors: Damien Bernard Emeric Guegan, Moissy-Cramayel (FR); Prasaad Cojande, Moissy-Cramayel (FR); Pierre-Hugues Ambroise Maxime Victor Retiveau, Moissy-Cramayel (FR); Jonathan Evert Vlastuin, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 68 days.

(21) Appl. No.: 16/478,972

(22) PCT Filed: Jan. 25, 2018

(86) PCT No.: PCT/FR2018/050168

§ 371 (c)(1),
(2) Date: Jul. 18, 2019

(87) PCT Pub. No.: WO2018/138439

PCT Pub. Date: Aug. 2, 2018

(65) Prior Publication Data

US 2019/0368356 A1 Dec. 5, 2019

(30) Foreign Application Priority Data

Jan. 30, 2017 (FR) ..... 1750726

(51) Int. Cl.
*F01D 5/14* (2006.01)
*F04D 29/32* (2006.01)

(52) U.S. Cl.
CPC ..... *F01D 5/141* (2013.01); *F04D 29/324* (2013.01); *F05D 2240/121* (2013.01);
(Continued)

(58) Field of Classification Search
None
See application file for complete search history.

(56) References Cited

U.S. PATENT DOCUMENTS 1,862,827 A * 6/1932 Carnegie ..... F01D 5/146 416/224
3,403,893 A * 10/1968 Stoffer ..... F04D 29/324 416/228

(Continued)

FOREIGN PATENT DOCUMENTS

WO WO 2012/080669 A1 6/2012
WO WO 2013/130163 A1 9/2013

OTHER PUBLICATIONS

International Search Report dated Apr. 16, 2018, in International Application No. PCT/FR2018/050168 (3 pages).

*Primary Examiner* — Ninh H. Nguyen
*Assistant Examiner* — Jason Fountain
(74) *Attorney, Agent, or Firm* — Bookoff McAndrews, PLLC

(57) ABSTRACT

A vane configured to be placed with a plurality of identical vanes so as to form a vane wheel for an aeroengine, the vane wheel defining an axis, the vane having an airfoil presenting a leading edge and a trailing edge, the leading-edge curve describing the shape of the leading edge of the airfoil in a view perpendicular to the airfoil presenting at least one leading-edge undulation, said at least one leading-edge undulation extending over less than 30% of a length of the airfoil from the first end of the airfoil.

9 Claims, 3 Drawing Sheets

(52) U.S. Cl.
CPC .. *F05D 2240/303* (2013.01); *F05D 2250/611* (2013.01); *F05D 2250/71* (2013.01)

(56) References Cited

U.S. PATENT DOCUMENTS

| | | | | |
|---|---|---|---|---|
| 8,535,008 | B2 * | 9/2013 | Dewar | F03B 3/12 416/170 R |
| 9,249,666 | B2 * | 2/2016 | Wood | F03D 1/0633 |
| 10,358,938 | B2 * | 7/2019 | Romano | F01D 9/041 |
| 10,443,399 | B2 * | 10/2019 | Jones | F01D 5/187 |
| 10,539,025 | B2 * | 1/2020 | Kray | F01D 5/141 |
| 2009/0074578 | A1 * | 3/2009 | Dewar | F03B 3/12 416/147 |
| 2013/0164488 | A1 * | 6/2013 | Wood | F01D 9/041 428/80 |
| 2018/0023403 | A1 * | 1/2018 | Jones | F01D 5/186 415/115 |

* cited by examiner

LEADING EDGE PROFILE OF VANES

CROSS-REFERENCE TO RELATED APPLICATIONS

This application is the U.S. national phase entry under 35 U.S.C. § 371 of International Application No. PCT/FR2018/050168, filed on Jan. 25, 2018, which claims priority to French Patent Application No. 1750726, filed on Jan. 30, 2017.

FIELD OF THE INVENTION

The present invention relates to the field of axial compressors in aeroengines, and more precisely to the vanes of such axial compressors, and in particular the leading edge profile of the airfoils of such vanes.

STATE OF THE PRIOR ART

An axial compressor of an aeroengine comprises a plurality of rotor stages and a plurality of stator stages that alternate along a shaft defining the axis of the compressor. The fluid flowing through the compressor runs substantially parallel to the axis of the shaft. The stator stages may be invariable, the airfoils not being movable relative to the casing of the compressor, or they may be of variable pitch, with the airfoils being capable of pivoting about their longitudinal directions (corresponding to radial directions of the stator). Stator stages, whether invariable or of variable pitch are referred to herein as "nozzles". Each invariable or variable pitch nozzle serves to:

- redirect the flow that has had its direction modified by the preceding rotor so that it returns to a direction substantially parallel to the axis of the compressor; and
- convert the kinetic energy acquired from the rotors into pressure by reducing the speed of the flow between the upstream and downstream ends of a given nozzle.

In order to improve the weight/thrust ratio of aeroengines, the present trend consists in limiting the number of stages or the number of airfoils per stage, while increasing the increase in the static pressure of the flow on passing through each nozzle.

Unfortunately, this increase in the static pressure on passing through a nozzle can give rise to an adverse pressure gradient opposing the flow direction. At the root of an airfoil, i.e. close to the shaft of the compressor, these adverse pressure gradients can give rise to radial and/or tangential separations in the flow on the suction sides of the nozzle. These separations can disturb the flow through the compressor and can thus degrade its performance. When they grow larger, these separations can give rise to the surge phenomenon which leads to the flow rate oscillating, to a sudden drop in performance, or indeed to serious damage to the compressor. The "surge margin" gives the difference between the nominal operating speed of the engine and the speed from which the surge phenomenon appears. It is therefore important, when designing a compressor, to dimension the compressor so as to conserve a surge margin that is sufficient to retard as much as possible the appearance of the surge phenomenon.

Consequently, the improvement in the performance of axial aeroengine compressors, in terms of weight/thrust ratio, comes up at present against constraints associated with this phenomenon. There therefore exists a need for a device that enables this performance to be improved, while conserving a sufficient surge margin.

SUMMARY OF THE INVENTION

To satisfy this need, the invention provides a vane configured to be placed with a plurality of identical vanes so as to form a vane wheel for an aeroengine, the vane wheel defining an axis, the vane having an airfoil presenting a leading edge and a trailing edge, the leading-edge curve describing the shape of the leading edge of the airfoil in a view perpendicular to the airfoil presenting at least one leading-edge undulation, said at least one leading-edge undulation extending over less than 30% of the length of the airfoil from a first end of the airfoil.

The term "undulation" is defined relative to a reference curve: the reference curve is the curve that subtends the curve under study but with curvature that is regular, and without localized variations in shape. Herein the term "undulation" designates a portion of the curve situated between two minimums and including a single maximum, said minimums and maximum being defined relative to a reference curve. The leading-edge undulations are thus defined relative to a reference leading-edge curve.

In the present disclosure, an axial direction corresponds to the axis of the engine. A longitudinal direction of the airfoil designates the direction in which the airfoil extends mainly, which is the radial direction once the vane is integrated in a vane wheel. When a vane is mounted on a vane wheel, the longitudinal direction of its airfoil corresponds to the radial direction of the wheel. Consequently, the "length" of the airfoil should be understood as being its length in the longitudinal direction. A view is said to be "perpendicular" to the airfoil when it is a side view perpendicular to a face of the airfoil that may be the pressure side or the suction side of the airfoil. Thus, in a projection in this view, the leading edge of the airfoil defines a curve connecting together the two ends of the airfoil in the longitudinal direction.

The leading-edge curve defining the leading edge profile of the airfoil presents at least one leading-edge undulation extending over less than 30% of the airfoil in the longitudinal direction from one end of the airfoil. The minimums correspond to recessed portions of the leading edge, and the maximum corresponds to a projecting portion of the airfoil. By way of example, the recessed portions may be made by machining. An undulation can thus be made in the leading edge simply and quickly. Preferably, over the remaining two-thirds of the length of the airfoil without any undulations in the leading edge, the leading-edge curve is monotonic. It can be understood that the leading-edge curve is the curve expressing a distance between the leading edge and the longitudinal axis of the airfoil in projection in the above-specified view perpendicular to the airfoil.

The presence of one or more leading-edge undulations presents the advantage of limiting the presence of radial and/or tangential separations of the flow over the suction side of the vane when the vane is mounted on a vane wheel in an axial compressor. The appearance of the surge phenomenon, and thus the corresponding degradation in the performance of the compressor can thus be delayed.

In certain embodiments, the leading-edge curve is monotonic over a range going from 30% to 70% of the length of the airfoil. This range of 30% to 70% is complementary to the range presenting the undulation.

In certain embodiments, the first leading-edge undulation extends from the end of the airfoil over less than 30% of the length of the airfoil, preferably over less than 20%, more preferably over less than 10%.

Preferably, the leading edge presents one or more undulations in the range 0 to 30% of the length of the airfoil, or indeed 0 to 20% or even 0 to 10%, followed by a leading-edge curve portion that is monotonic extending from said one or more undulations to at least 70% of the length of the airfoil.

The fact that the leading-edge undulation(s) is/are arranged locally at one end of the airfoil serves to limit radial and/or tangential separations in the flow, without disturbing the flow over the entire length of the airfoil, and thus without degrading its aeronautical performance, when the vane is mounted on a vane wheel in an axial compressor. Furthermore, it suffices for the undulations to be arranged in the vicinity of the leading edge. There is no need for them to affect the shape of the airfoil beyond the upstream third of the airfoil (measured from the leading edge to the trailing edge).

In certain embodiments, the leading-edge undulations may be defined by local variation in the chord of the airfoil.

Specifically, in the view perpendicular to the airfoil, the curve defining the trailing edge of the airfoil may present a profile that is linear and constant. Under such circumstances, the variations in the chord of the airfoil, in its longitudinal direction, correspond to the variations in the leading-edge curve. Thus, a recessed portion in the leading edge is characterized by a local minimum of the chord, and a projecting portion of the leading edge is characterized by a local maximum of the chord.

In certain embodiments, the vane has a root and a tip at its ends, and the leading-edge curve presents at least one leading-edge undulation extending from the airfoil root over less than 30% of the length of the airfoil, and/or at least one leading-edge undulation extending from the airfoil tip over less than 30% of the length of the airfoil.

Having the leading-edge undulation arranged at one or both ends of the airfoil serves to limit radial and/or tangential separations of the flow without disturbing the flow over the entire length of the airfoil between those two ends, and thus without degrading the aeronautical performance of the airfoil when the vane is mounted on a vane wheel in an axial compressor.

In certain embodiments, the angle-of-attack curve presents two or three angle-of-attack undulations extending from the airfoil root over less than one-third of the length of the airfoil, and/or two or three angle-of-attack undulations extending from the airfoil tip over less than one-third of the length of the airfoil. These undulations may be more numerous, for example there may be four or five of them.

The presence of a plurality of leading-edge undulations arranged at one end or at both ends of the airfoil serves to optimize the performance of the airfoil, by further limiting radial and/or tangential separations of the flow on the suction side of the vane, when the vane is mounted on a vane wheel, in an axial compressor. The appearance of the surge phenomenon, and also major degradation of the compressor can thus be retarded even more.

Furthermore, the undulations of the leading-edge curve may advantageously be coupled with certain modifications that affect the camber line of the airfoil. The (mean) camber line in a plane at a given level in the longitudinal direction of the airfoil is the curve connecting together the leading and trailing edges of the airfoil and defining the camber of the airfoil. The angle of attack is the angle between the camber line at the leading edge of the airfoil and the axis of the vane wheel in a plane at a given level in the longitudinal direction of the airfoil.

It can be understood that the angle of attack is the angle formed between the tangent to the camber line at the leading edge of the airfoil and the axis of the wheel when the vane is mounted on a vane wheel. Furthermore, the angle-of-attack curve defines how this angle of attack varies in the longitudinal direction of the airfoil, or along it.

In certain embodiments, the angle-of-attack curve defining how the angle of attack varies along the airfoil presents at least one angle-of-attack undulation extending over less than one-third of the length of the airfoil from the first end of the airfoil in the longitudinal direction, relative to a reference angle-of-attack curve.

Preferably, over the central portion of the airfoil that does not have any angle-of-attack undulation, the leading-edge curve is preferably monotonic.

In combination with the leading-edge undulation(s), the presence of this angle-of-attack undulation presents the advantage of limiting the presence of radial and/or tangential separations of the flow over the suction side of the vane when the vane is mounted on a vane wheel in an axial compressor. The appearance of the surge phenomenon, and also major degradation in the compressor can thus be retarded even more effectively.

In certain embodiments, the angle-of-attack curve presents at least one angle-of-attack undulation extending from the root of the airfoil over less than one-third of the length of the airfoil, and/or at least one angle-of-attack undulation extending from the tip of the airfoil over less than one-third of the length of the airfoil.

In certain embodiments, the angle-of-attack curve presents two or three angle-of-attack undulations extending from the airfoil root over less than one-third of the length of the airfoil, and/or two or three angle-of-attack undulations extending from the airfoil tip over less than one-third of the length of the airfoil. These undulations may be more numerous, e.g. there may be four or five of them.

In certain embodiments, at least one maximum of an undulation of the leading-edge curve is arranged closer in the longitudinal direction of the airfoil to a minimum of the angle-of-attack curve (the closest minimum of the angle-of-attack curve) than to a maximum of an angle-of-attack undulation (the closest maximum of an angle-of-attack undulation).

Preferably, when each of the leading-edge curve and the angle-of-attack curve present one undulation, by way of example, the maximums of each of them are not in register with each other. Thus, when the leading-edge curve and the angle-of-attack curve are drawn in the same reference frame, the maximums in each of them present a mutual phase offset. More precisely, the maximum of each of them is located closer to a minimum of the other curve. In other words, in the airfoil, a maximum of the angle-of-attack curve is arranged level with a projecting portion of the leading edge, and a minimum of the angle-of-attack curve is arranged level with a recessed portion.

This arrangement of the respective maximums and minimums in each of the curves serves to optimize the aerodynamic performance of the vane by limiting the presence of radial and/or tangential separations in the flow over the suction side of the vane when the vane is mounted on a vane wheel in an axial compressor. The appearance of the surge phenomenon, and also major degradation of the compressor can thus be retarded further.

In certain embodiments, at least one maximum included in an undulation of the leading-edge curve is arranged substantially at the same position in the longitudinal direction of the airfoil as a minimum defining an angle-of-attack undulation.

The present disclosure also provides a vane wheel having a plurality of vanes in accordance with any of the above embodiments.

BRIEF DESCRIPTION OF THE DRAWINGS

The invention and its advantages can be better understood on reading the following detailed description of various embodiments of the invention given as non-limiting examples. The description refers to the accompanying sheets of figures, in which.

DETAILED DESCRIPTION OF EMBODIMENTS

Figure 1:
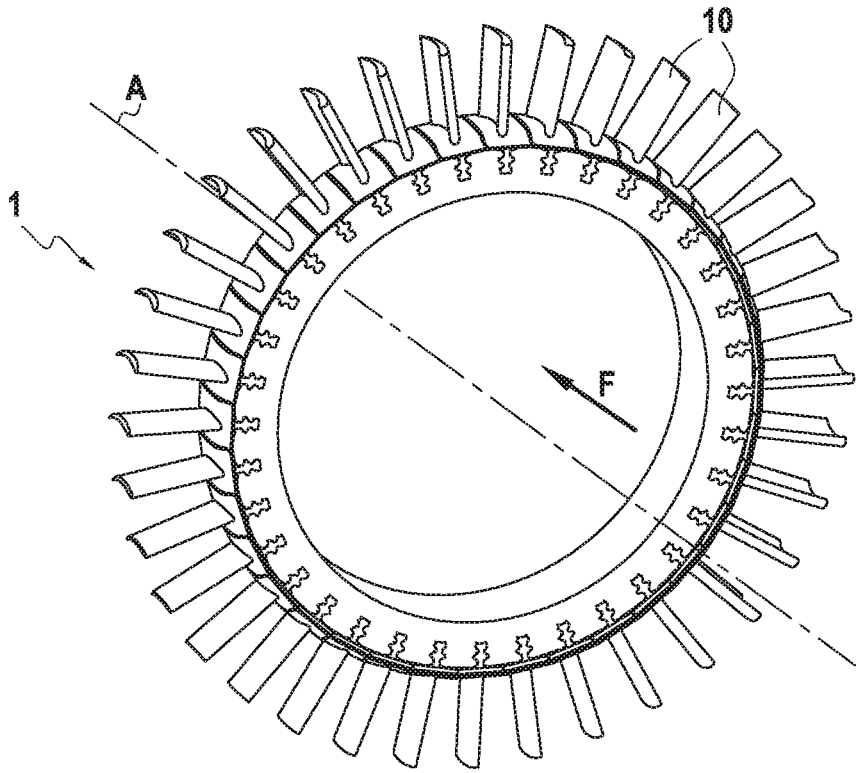
FIG. 1 is a diagram of an aeroengine vane wheel.

FIG. 1 shows a vane wheel 1 constituting a stage of an axial compressor of an aeroengine (not shown) comprising a plurality of rotor stages and a plurality of stator stages arranged in alternation along a shaft defining the axis A of the compressor. The vane wheel 1 (or nozzle) is a stator stage of the compressor, having a plurality of vanes. The stator may be invariable, the vanes being invariable relative to the casing of the compressor, or it may be a variable pitch stator, with vanes that can pivot about their longitudinal directions (corresponding to radial directions of the stator). Arrow F shows the flow direction of air relative to the vane wheel 1.

In the description below, the terms "upstream" and "downstream" should be understood relative to the flow direction of air. The direction z designates a direction in which an airfoil 10 extends radially relative to the vane wheel 1, between its airfoil root 12 and its airfoil tip 14. Thus, terms involving the "height" of the airfoil or "along" the airfoil should be understood as being along this direction z. The direction y designates a direction perpendicular to the direction z, in which an airfoil 10 extends between its leading edge 10*a* and its trailing edge 10*b*. In other words, the direction y is parallel to the chord 30 of the airfoil 10. The direction x is the direction perpendicular to the directions y and z, and generally represents the thickness of the airfoil 10.

Figure 2:
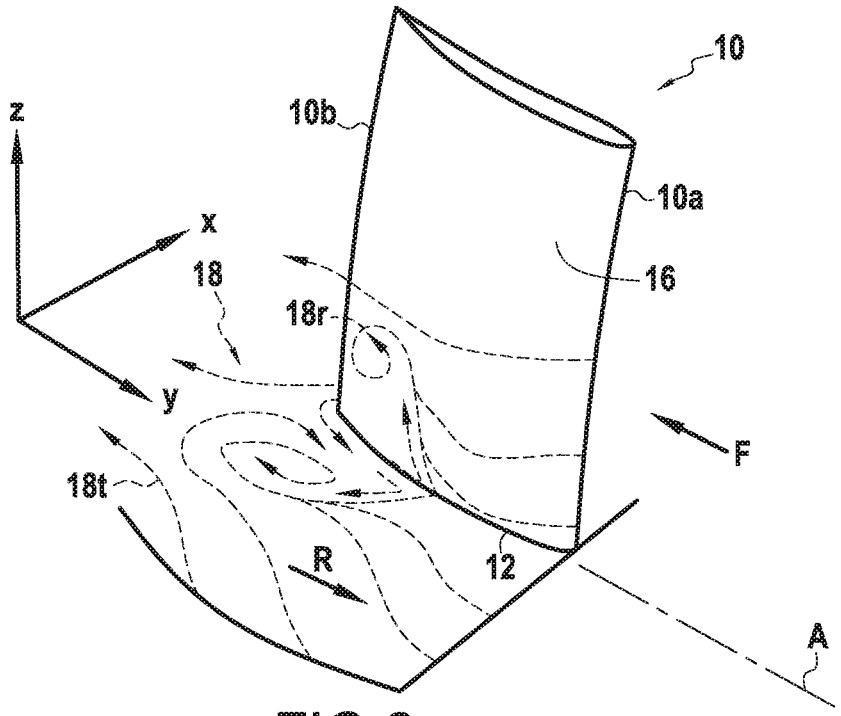
FIG. 2 is a diagram showing recirculation lines on a vane of the FIG. 1 vane wheel.

FIG. 2 is a fragmentary view of a vane of the vane wheel 1 (the tip of the vane is not shown). Each vane comprises an airfoil 10 with a leading edge 10*a*, a trailing edge 10*b*, an airfoil root 12, an airfoil tip, and a suction side surface 16. The increase in static pressure on going through the vane wheel 1 can lead to an adverse pressure gradient opposing the flow direction, as represented by arrow R in FIG. 2. At the airfoil root 12, these adverse pressure gradients can give rise to separations 18 comprising radial separations 18*r* and/or tangential separations 18*t* of the flow over the suction side 16 of the airfoil 10, that can disturb the flow through the compressor and thereby degrade its performance.

Figure 3:
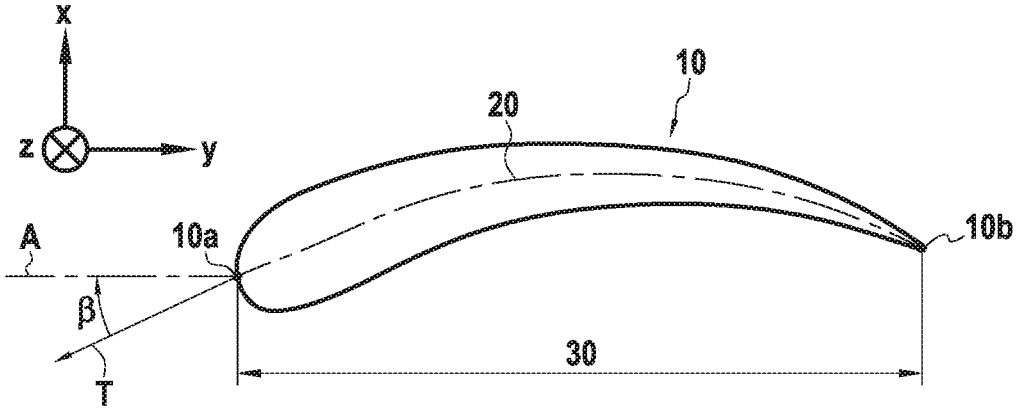
FIG. 3 is a section view of the FIG. 2 vane.

FIG. 3 is a section view of the airfoil 10, in a plane parallel to the plane x-y. In this view, the (mean) camber line 20 is the curve connecting the leading edge 10*a* to the trailing edge 10*b* of the airfoil 10 and defining the camber of the airfoil 10. The camber line is defined by the set of the centers of circles inscribed in the profile of the vane over its extent between its leading edge and its trailing edge, each inscribed circle being tangential to the pressure side curve and to the suction curve. The angle of attack β is the angle formed between the tangent T to the camber line 20 at the leading edge 10*a* of the airfoil 10 and the axis A of the wheel, when the vane is mounted on the vane wheel. In FIG. 3, the angle β is thus positive. The angle-of-attack curve defines how this angle of attack β varies along the direction z, along the airfoil 10.

Figure 4:
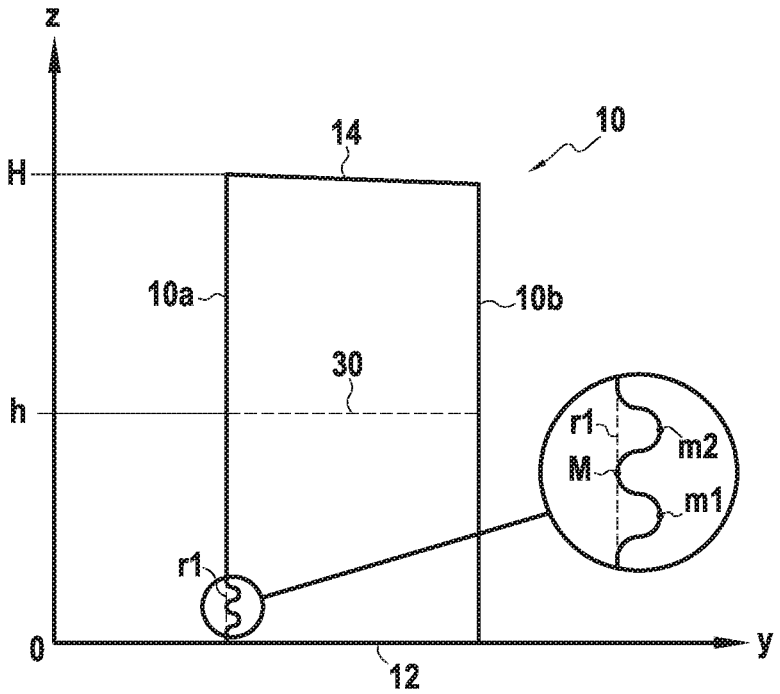
FIG. 4 shows the profile of the leading edge of a vane in an embodiment of the invention.

FIG. 4 is a side view, which is a view perpendicular to the y-z plane of an airfoil 10 similar to the airfoil 10 described above. This view is thus a view perpendicular to the airfoil 10. In this view, the leading-edge curve defines how the profile of the leading edge 10*a* varies along the direction z. In other words, the leading-edge curve corresponds, in the view of FIG. 4, to the variations of the upstream end (on the left in FIG. 4) of the airfoil. The airfoil 10 shown in FIG. 4 represents a vane of the invention in which the leading-edge curve includes a leading-edge undulation. The term "undulation" designates a curve portion situated between two minimums m1 and m2 on either side of a single maximum M. Furthermore, H designates the total height of the airfoil between the airfoil root 12 and the airfoil tip 14, and h designates any arbitrary height up the airfoil, such that $0 \leq h \leq H$. As can be seen, the undulations are arranged on the airfoil side relative to the reference leading-edge curve r1; in other words in the minimums m1 and m2 the airfoil presents two portions that are recessed relative to the airfoil shape defined by the reference leading-edge curve r1, and it has no portions projecting beyond this shape.

In addition, FIG. 4 also shows the profile of the trailing edge 10*b*. In this example, the trailing edge curve is monotonic and almost straight over the full height H of the airfoil 10 (in other words, the distance between the trailing edge and the axis of the airfoil is constant over the entire height H of the airfoil 10). Consequently, the profile of the leading edge 10*a*, seen in a view perpendicular to the y-z plane, may also be defined by variations in the chord 30.

Figure 5:
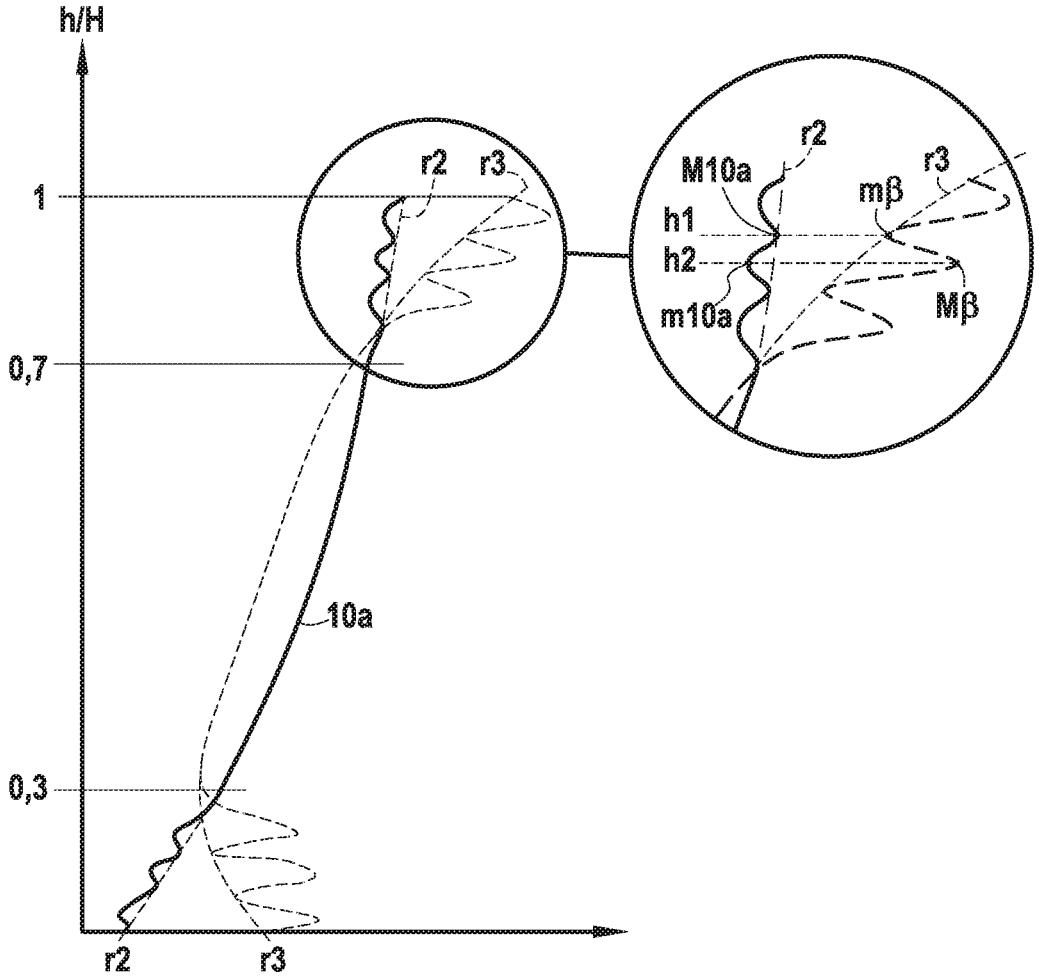
FIG. 5 shows the variation in leading edge and angle-of-attack curves in a second embodiment of the invention.

A second embodiment of the invention with a second leading edge profile is described below with reference to FIG. 5. FIG. 5 shows variations in the leading-edge curve (continuous line in FIG. 5) and in the angle-of-attack curve (dashed line in FIG. 5) along the airfoil 10. The position along the height H of the airfoil 10 is identified by a dimensionless number h/H. The curve r2 represents the reference leading-edge curve that subtends the angle-of-attack curve 10*a*, and the curve r3 represents the reference angle-of-attack curve, that subtends the angle-of-attack curve.

In this example, the leading-edge curve has two undulations in the leading edge 10*a* extending from the airfoil root 12, over a height range of the airfoil 10 corresponding to $0 \leq h/H \leq 0.3$ (i.e. over about one-third of the height of the airfoil 10). The leading-edge curve also has two leading-edge undulations 10*a* extending from the airfoil tip 14 over a height range of the airfoil 10 corresponding to $0.7 \leq h/H \leq 1$ (i.e. over about one-third of the height of the airfoil 10). Between a minimum and a maximum of the leading-edge curve, the amplitude of the variations in the leading edge 10*a* lies in the range 1% to 10%, preferably in the range 1% to 5%, more preferably in the range 3% to 5% of the mean length of the chord of the airfoil. In addition, over a range of height of the airfoil 10 corresponding to $0.3 \leq h/H \leq 0.7$, preferably $0.2 \leq h/H \leq 0.8$, the leading-edge curve 10*a* is monotonic.

Furthermore, the leading-edge curve has three leading-edge undulations β extending from the airfoil root 12 over a range of heights of the airfoil 10 corresponding to $0 \leq h/H \leq 0.3$ (i.e. over about one-third of the height of the airfoil 10). The leading-edge curve also has three angle-of-attack undulations β extending from the airfoil tip 14 over a range of heights of the airfoil 10 corresponding to $0.7 \leq h/H \leq 1$ (i.e. over about one-third of the height of the airfoil 10), preferably $0.8 \leq h/H \leq 1$. Between a minimum and a maximum of the angle-of-attack curve, the amplitude of variations in the angle of attack β lies in the range 0.5° to 10°, preferably in the range 0.5° to 5°, more preferably in the range 1° to 3°. In addition, over a range of heights of the airfoil 10 corresponding to $0.3 \leq h/H \leq 0.7$, preferably $0.2 \leq h/H \leq 0.8$, the angle-of-attack curve β is monotonic.

The leading-edge undulations 10*a* and the angle-of-attack undulations β are mutually offset. In other words, for a given height h1 of the airfoil 10, corresponding to a maximum M10*a* of the leading-edge undulation, the angle-of-attack curve at the same height h1 presents a minimum mβ. Conversely, for a given height h2, a maximum Mβ of an angle-of-attack undulation corresponds to a minimum m10*a* of a leading-edge undulation.

The combination of the leading-edge undulations and these angle-of-attack undulations, the way they are arranged at the airfoil root 12 and at the airfoil tip 14, and the way they are offset in phase makes it possible to obtain a profile for the leading edge 10*a* of the airfoil 10 that presents the advantage of limiting the phenomenon of separation at the airfoil root 12 and at the airfoil tip 14, thereby serving to improve the surge margin. When this configuration for the airfoil angle of attack is applied to all of the vanes of a vane wheel, and to all of the vane wheels (nozzles) of an axial compressor, the surge margin may be improved by 2%, for example, without any need to reduce the flow rate, the compression ratio, or the efficiency of the compressor.

Although the present invention is described with reference to specific embodiments, it is clear that modifications and changes may be undertaken thereon without going beyond the general ambit of the invention as defined by the claims. In particular, individual characteristics of the various embodiments illustrated and/or mentioned may be combined in additional embodiments. Consequently, the description and the drawings should be considered in a sense that is illustrative rather than restrictive.

The invention claimed is:

1. A vane configured to be placed with a plurality of identical vanes so as to form a vane wheel for an aeroengine, the vane comprising a root and a tip at its ends, the vane wheel defining an axis, the vane comprising an airfoil presenting a leading edge and a trailing edge, a leading-edge curve describing the shape of the leading edge of the airfoil in a view perpendicular to the airfoil presenting at least one leading-edge undulation, said at least one leading-edge undulation extending over less than 30% of a length of the airfoil from an airfoil root and at least one leading-edge undulation extending from an airfoil tip over less than 30% of the length of the airfoil, the leading-edge curve being monotonic over the range going from 30% to 70% of the length of the airfoil, and an angle of attack being an angle between a tangent to a camber line at the leading edge of the airfoil and the axis of the vane wheel in a view in a longitudinal direction of the airfoil, an angle-of-attack curve describing a variation of the angle of attack along the airfoil presents at least one angle-of-attack undulation extending over less than one third of the length of the airfoil from the airfoil root, and the angle-of-attack curve presenting at least one angle-of-attack undulation extending from the airfoil tip over less than one-third of the length of the airfoil;

wherein, for an undulation being a curve portion situated between two minimums and including a single maximum, at least one maximum included in an undulation of the leading-edge curve is arranged substantially at the same position in the longitudinal direction of the airfoil as a minimum defining an angle-of-attack undulation.

2. The vane according to claim 1, wherein the angle-of-attack leading edge curve presents two or three angle-of-attack leading edge undulations extending from the airfoil root over less than one-third of the length of the airfoil, and/or two or three angle-of-attack leading edge undulations extending from the airfoil tip over less than one-third of the length of the airfoil.

3. The vane according to claim 1, wherein the angle-of-attack curve presents two or three angle-of-attack undulations extending from the airfoil root over less than one-third of the length of the airfoil, and/or two or three angle-of-attack undulations extending from the airfoil tip over less than one-third of the length of the airfoil.

4. A vane wheel comprising a plurality of vanes according to claim 1.

5. A vane configured to be placed with a plurality of identical vanes so as to form a vane wheel for an aeroengine, the vane comprising a root and a tip at its ends, the vane wheel defining an axis, the vane comprising an airfoil presenting a leading edge and a trailing edge, a leading-edge curve describing the shape of the leading edge of the airfoil in a view perpendicular to the airfoil presenting at least one leading-edge undulation, said at least one leading-edge undulation extending over less than 30% of a length of the airfoil from an airfoil root and at least one leading-edge undulation extending from an airfoil tip over less than 30% of the length of the airfoil, the leading-edge curve being monotonic over the range going from 30% to 70% of the length of the airfoil, and an angle of attack being an angle between a tangent to a camber line at the leading edge of the airfoil and the axis of the vane wheel in a view in a longitudinal direction of the airfoil, an angle-of-attack curve describing a variation of the angle of attack along the airfoil presents at least one angle-of-attack undulation extending over less than one third of the length of the airfoil from the airfoil root, and the angle-of-attack curve presenting at least one angle-of-attack undulation extending from the airfoil tip over less than one-third of the length of the airfoil;

wherein, for an undulation being a curve portion situated between two minimums and including a single maximum, at least one maximum of an undulation of the leading-edge curve lies closer, in the longitudinal direction of the airfoil, to a minimum of an undulation of the angle-of-attack curve than to a maximum of the undulation of the an angle-of-attack curve.

6. The vane according to claim 5, wherein the angle-of-attack leading edge curve presents two or three angle-of-attack leading edge undulations extending from the airfoil root over less than one-third of the length of the airfoil, and/or two or three angle-of-attack leading edge undulations extending from the airfoil tip over less than one-third of the length of the airfoil.

7. The vane according to claim 5, wherein the angle-of-attack curve presents two or three angle-of-attack undulations extending from the airfoil root over less than one-third of the length of the airfoil, and/or two or three angle-of-attack undulations extending from the airfoil tip over less than one-third of the length of the airfoil.

8. The vane according to claim 7, wherein at least one maximum included in an undulation of the leading-edge curve is arranged substantially at the same position in the longitudinal direction of the airfoil as a minimum defining an angle-of-attack undulation.

9. A vane wheel comprising a plurality of vanes according to claim 5.

* * * * *